United States Patent [19]

Haveman et al.

[11] Patent Number: 4,625,787

[45] Date of Patent: Dec. 2, 1986

[54] METHOD AND APPARATUS FOR CONTROLLING THE LEVEL OF LIQUID METAL IN A CONTINUOUS CASTING MOLD

[75] Inventors: David L. Haveman, Carleton, Mich.; John C. Powell, Oakdale, Pa.

[73] Assignee: National Steel Corporation, Pittsburgh, Pa.

[21] Appl. No.: 693,197

[22] Filed: Jan. 22, 1985

[51] Int. Cl.[4] ..... B22D 11/18

[52] U.S. Cl. ..... 164/453; 164/449

[58] Field of Search ..... 164/453, 449, 450, 451

[56] References Cited

U.S. PATENT DOCUMENTS

| | | | |
|---|---|---|---|
| 3,300,820 | 1/1967 | Tiskus et al. | 164/449 |
| 3,358,743 | 12/1967 | Adams | 164/154 |
| 3,457,985 | 7/1969 | Wilson | 164/453 X |
| 3,537,505 | 11/1970 | Thalmann et al. | 164/453 |
| 3,614,978 | 10/1971 | Kosco | 164/154 |
| 3,946,795 | 3/1976 | Bruderer et al. | 164/154 |
| 4,077,457 | 3/1978 | Hashio et al. | 164/453 |
| 4,226,278 | 10/1980 | Osugi | 164/449 |
| 4,306,610 | 12/1981 | Ahmed | 164/4.1 |
| 4,392,523 | 7/1983 | Beller et al. | 164/453 |

FOREIGN PATENT DOCUMENTS

| | | | |
|---|---|---|---|
| 55-5162 | 1/1980 | Japan | 164/449 |
| 56-165553 | 12/1981 | Japan | 164/449 |
| 57-159252 | 10/1982 | Japan | 164/449 |
| 59-19061 | 1/1984 | Japan | 164/453 |
| 2057715A | 4/1981 | United Kingdom | 164/449 |

*Primary Examiner*—Nicholas P. Godici
*Assistant Examiner*—J. Reed Batten, Jr.
*Attorney, Agent, or Firm*—O'Neil and Bean

[57] ABSTRACT

The level of molten metal in the mold of a continuous metal caster is controlled by regulating the open area of a variable outlet nozzle in a tundish. The level of molten metal is monitored, and the extent and direction of any detected deviation is signalled to a computer which also receives a signal indicating the position of a movable valve member in the tundish outlet nozzle and a separate signal representing the rate of withdrawal of the cast metal from the mold. The computer determines the extent of movement of the valve member to correct the liquid metal level in the mold and controls actuation of a hydraulic drive system to move the valve member to reduce the position error to zero. The velocity of movement of the valve member is measured and fed back to the computer, with the velocity measurement being utilized by the computer to control the hydraulic system and more accurately position the movable valve member.

9 Claims, 6 Drawing Figures

10
16
12
14
18
20
22
24
28
28
30
32
34
36
38
40
42
44
46
48
50
64
COMPUTER
SOL
SOL
V
P

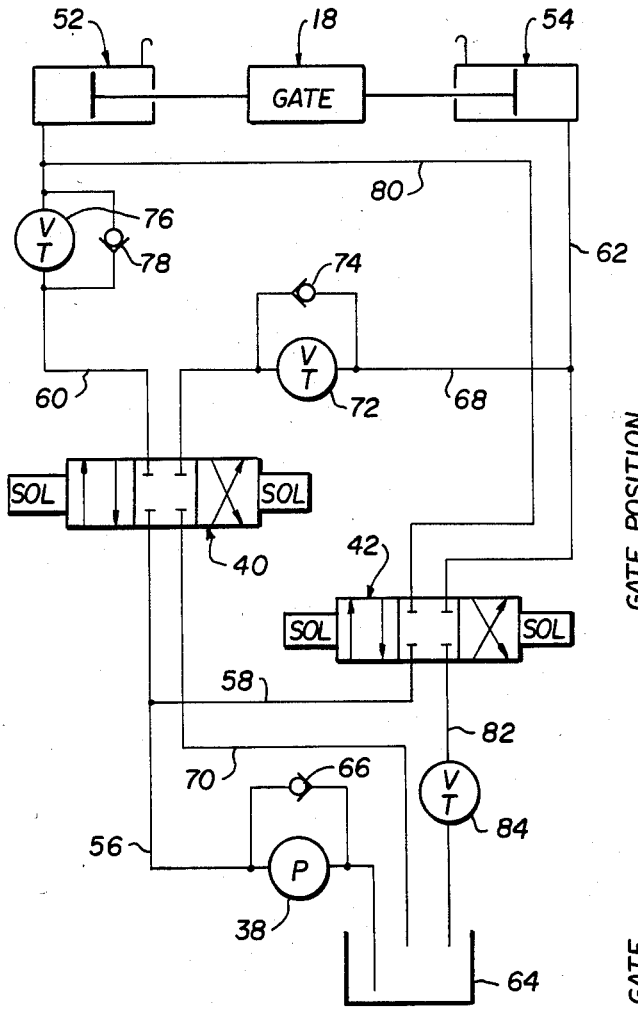
FIG. 2
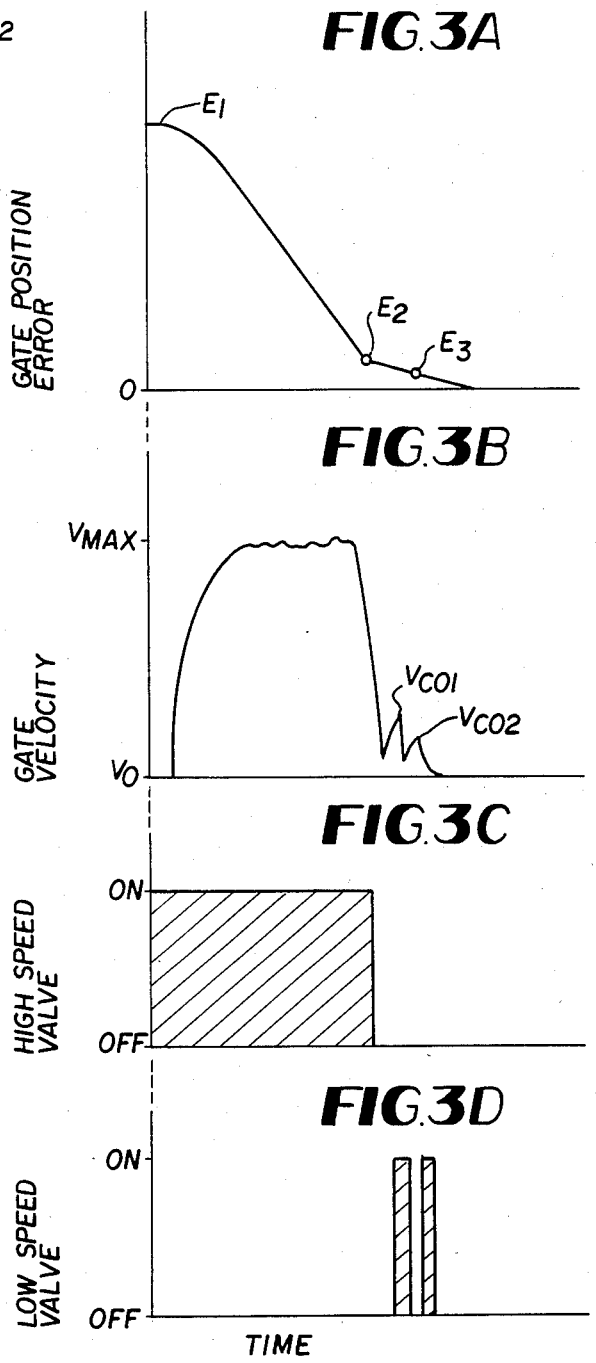

METHOD AND APPARATUS FOR CONTROLLING THE LEVEL OF LIQUID METAL IN A CONTINUOUS CASTING MOLD

BACKGROUND OF THE INVENTION

1. Field of the Invention

This invention relates to the continuous casting of metals and more particularly to an improved method of and apparatus for controlling the level of molten metal in the mold of a continuous caster.

2. Description of the Prior Art

In the continuous casting of metal, it is important to maintain the level of the liquid metal in the mold at the optimum level both to obtain maximum production within the mold's capacity and to insure against inferior product or excessive down time which can result from excessive deviation from the optimum metal level and which can produce breakouts or other failures. Numerous devices have been developed for continuously monitoring the level of liquid metal in the caster mold, and for automatically adjusting the metal level upon an excessive deviation being detected. The metal level has been controlled by varying the withdrawal rate of the cast strand, by adjusting the flow rate of liquid metal from the tundish to the caster mold, or by a combination of these two methods. Initially maintaining the molten metal at the desired level was under control of an operator who monitored the mold and made the necessary adjustments, one such system being disclosed, for example, in U.S. Pat. No. 2,832,110.

More recent developments for monitoring and controlling the molten metal level in a continuous caster mold have included computerized control systems which are more reliable and more responsive to small deviations from the desired level. Such systems have employed automatic metal level sensing devices including thermocouples in the mold wall, eddy current sensors and optical devices which function to detect and signal deviations from a reference liquid level. The level deviation signal is then employed to regulate the withdrawal speed of the strand or to adjust a throttling valve opening to control the flow of metal from the tundish into the mold. For example, U.S. Pat. No. 3,946,795 discloses a system employing a radio-active emitter and receiver for detecting deviations from a predetermined level both in the positive and negative directions and signalling the measured deviations to a controller which adjusts the withdrawal speed of the strand as required to bring the level of liquid metal back to the desired level.

U.S. Pat. No. 3,300,820 discloses a system which includes a molten level detecting apparatus which develops a DC signal whose polarity is an indication of the direction of deviation from a preselected level and the magnitude of the signal is an indication of the extent of such deviation. The error signal is employed to adjust the position of the stopper rod in the tundish outlet nozzle by energizing a solenoid in a hydraulic control system to adjust the stopper in the appropriate direction. A time delay relay is connected in the circuit controlling the hydraulic system to minimize overshooting or hunting of the system.

In addition to sensing the molten metal level, it is also known to continuously sense the position of the tundish sliding gate valve or stopper valve (throttling valves) and to utilize a computer to calculate the open area through which the molten metal flows into the mold.

The open valve area and measured metal level deviation can then be utilized to calculate a new open area desired to correct any deviation from the desired mold level, and to actuate the throttling valve for a predetermined time which the computer determines to be necessary to produce the new area.

While the prior art systems of the type described above have been utilized with more or less success, they have not been entirely satisfactory for various reasons. For example, when a sliding gate is employed to control flow from the tundish, a circular opening in the gate overlies a corresponding circular opening in the bottom wall of the tundish, with the two being completely aligned for maximum flow. As the sliding gate is moved to restrict flow, the open area varies with sliding movement in accordance with a complex formula, producing a continuously changing geometry for the net opening which, in turn, produces flow restrictions which vary with the fluid flow characteristics and the liquid metal level in the tundish. Further, gate or stopper movement is not always precise as a result of various factors including sliding friction, variations in hydraulic pressure in the actuating system, gases in the hydraulic fluid and the like. Such systems also have generally required complex and expensive actuating equipment in order to produce as closely as possible the desired movement. Nevertheless, such known systems are subject to substantial hunting, overshooting and time lag, with the result that the mold level is not maintained with the desired degree of consistency. Accordingly, it is a primary object of the present invention to provide an improved method of and apparatus for controlling the level of liquid metal in a continuous casting mold.

Another object of the invention is to provide such a method and apparatus which maintains the desired liquid metal level with substantially greater accuracy by reducing overshoot or hunting by the system.

Another object is to provide such a method and apparatus employing a computer controlled actuating system for operating a slide gate throttling system for a tundish or ladle including both high and low speed actuating hydraulic systems for positioning the throttling gate to control the flow of metal and maintain the proper level.

Another object is to provide such a method and apparatus in which the rate of movement of the throttling gate is sensed and fed to the computer which utilizes the rate signal to more accurately determine the gate movement cutoff, thereby providing more accurate control of metal level in the mold.

SUMMARY OF THE INVENTION

The foregoing and other features and advantages are achieved in accordance with one embodiment of the present invention in which a slide gate throttling system is employed on a tundish or ladle for controlling the flow of molten metal into the mold of a continuous caster. A commercial molten metal level detector, for example, an eddy current detector, is employed in or on the mold to continuously monitor the level of molten metal in the mold and produce an electrical signal representative of the actual level in relation to a desired or predetermined level. The detector level signal is converted to a voltage signal fed to the computer, or microprocessor, as a continuous indication of the actual level of metal in the mold.

A gate position feedback transducer with two distinct output signals is connected to the throttling gate and connected to the computer to continuously provide information both as to the actual position of the slide gate and to the velocity of slide gate movement. The feedback transducer may include a potentiometer used as a voltage divider connected to the slide gate mechanism so that one terminal changes its voltage value as the position of the slide gate changes with this voltage being continuously fed to the computer to provide a continuous indication of the actual position of the slide gate.

A tachometer in the feedback transducer provides an output signal corresponding to the direction and magnitude of slide gate velocity, with this signal also being continuously fed to the computer. A fourth signal representing the rate of withdrawal of the cast strand from the mold, i.e., caster machine speed, is also fed to the computer which is programmed to utilize this information to compute a new desired slide gate open area needed to correct an error in mold level when such an error is sensed. Based upon the actual position of the slide gate, the computer converts the needed change in open area into slide gate position error or cylinder stroke required to produce the change and actuates a high speed valve to move the slide gate in the appropriate direction. The changing position of the slide gate is continuously monitored and when the position error is reduced to a predetermined value less than the total calculated value required to produce the desired open area change, the high speed hydraulic actuating valve is turned off.

The gate position error is determined at the time the high speed hydraulic actuating valve is turned off and a low speed actuating valve is opened prior to the slide gate velocity reaching zero. The low speed valve is retained open until the velocity of the gate is increased to a cutoff value ($V_{co1}$) determined by the computer from the gate position error at the time of opening the low speed valve. The gate position error is again determined when the low speed valve is closed and if the position error is above a predetermined minimum value, the low speed valve is again opened, preferably before the gate velocity reaches zero, and is retained open until the slide gate reaches a second cutoff velocity ($V_{co2}$) lower than $V_{co1}$. The second cutoff velocity is determined by the computer from the gate position error at the second opening of the low speed valve. The procedure of opening and closing the low speed valve is repeated until the gate position error approaches zero within acceptable limits. The slide gate is retained in its new position until the mold level sensor determines that the level has again deviated from the desired level and the procedure is repeated to again bring the slide gate to a new position to bring the liquid metal back to the desired level in the mold.

BRIEF DESCRIPTION OF THE DRAWINGS

The foregoing and other features and advantages of the invention will be apparent from the detailed description contained hereinbelow, taken in conjunction with the drawings, in which:

FIG. 2 is a schematic diagram of the hydraulic actuating system employed to position the slide gate of a ladle or tundish in a continuous caster; and FIGS. 3A, 3B, 3C and 3D are graphic illustrations showing, respectively, the gate position error, the slide gate velocity, and the duration of time the high and low speed control valves are open during adjustment of the slide gate position.

DESCRIPTION OF THE PREFERRED EMBODIMENT

Figure 1:
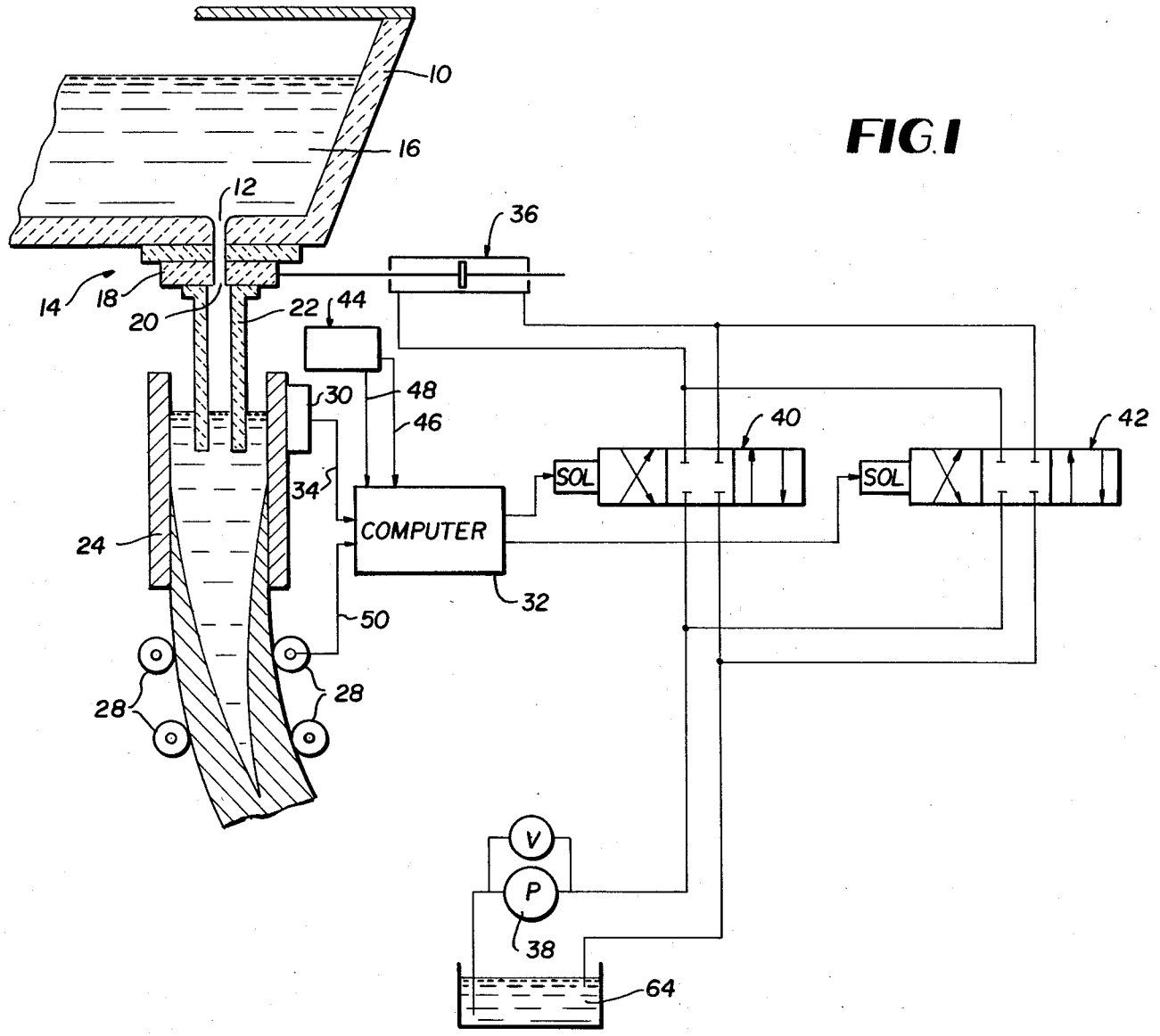
FIG. 1 is a schematic diagram illustrating the control circuit of the preferred embodiment of the present invention.

Referring now to the drawings in detail, FIG. 1 illustrates the liquid metal level control system employed in a continuous caster including a tundish 10 having an outlet opening 12 in its bottom wall leading to a throttling valve assembly 14 for controlling the flow of molten metal 16 from the tundish. Valve assembly 14 includes a sliding gate 18 having an opening 20 extending therethrough, with the opening 20 corresponding in size to the outlet opening 12 and communicating with the interior of a downwardly extending pour tube 22. The pour tube has its bottom open end disposed within the chilled mold 24 of the continuous caster, with the pour tube shielding the molten metal against oxidation and cooling in the atmosphere in its path from the tundish to the mold. The partially solidified slab is withdrawn from the open bottom of mold 24, with the slab being supported and controlled by a plurality of pairs of pinch rolls indicated schematically at 28. The structure thus far described is conventional in continuous casting operations.

A liquid level metal sensing device indicated generally at 30 is mounted in association with mold 24 in position to continuously monitor the level of liquid metal in the mold and to detect deviations, either above or below, a predetermined desired mold level. Level detector 30 may be of any suitable commercially available type, but should be sufficiently sensitive to accurately monitor the metal level in the mold and capable of signalling any excessive deviations from the desired predetermined level. A computer, or microprocessor 32 is employed to continuously monitor the various parameters of the control system, and level detector 30 continuously supplies a mold level signal on line 34 to the computer.

As is known, the level of molten metal in mold 24 depends upon the rate at which the partially solidified slab is withdrawn from the open bottom of the mold and the rate at which liquid metal flows from tundish 10 into the top of the mold, and both the slab withdrawal rate and molten metal in-flow rate are adjustable to enable the liquid metal in the mold to be maintained at an acceptable level. In the embodiment illustrated in the drawings, the rate of flow of molten metal through the throttling gate assembly 14 is controlled by laterally moving slide gate 18 to vary the alignment between the circular opening 20 and a corresponding circular opening 12 in the bottom of tundish 10. These openings may, for example, be about 3¼ inches in a continuous caster used in the casting of steel slabs. In the full open position illustrated in FIG. 1, openings 12 and 20 are axially aligned to produce maximum flow rate, with the effective open area decreasing with lateral displacement of slide gate 18.

Movement of valve slide gate 18 is controlled by a hydraulic piston drive, designated generally by the reference numeral 36 in FIG. 1, with the flow of hydraulic fluid supplied by a pump 38 through a high speed three-position four-way control valve 40 and a low speed three-position four-way control valve 42, with the actuation of valves 40 and 42 being under control of the computer 32 as more fully described hereinbelow. A gate position and velocity feedback transducer 44 is operatively connected with slide gate 18 to continuously monitor the position and rate of movement of the slide gate and to signal these variables to computer 32.

The feedback transducer 44 may include a potentiometer used as a voltage divider connected to the slide gate mechanism so that one terminal of the potentiometer changes its voltage value as the position of the slide gate changes, and this voltage is continuously fed to computer 32 on line 46 to provide a continuous indication of the actual position of the slide gate. A tactometer in the feedback transducer also provides an output signal corresponding to the rate of movement of the slide gate, and this signal is continuously fed to the computer on line 48. At the same time, a signal representing the rate of withdrawal of the cast strand from the mold, i.e., caster machine speed, is fed to the computer as indicated at 50 in FIG. 1.

The computer, or microprocessor 32, is programmed to utilize the information received from the mold level sensor 30, the slide gate transducer 44, and the caster speed signal to control actuation of high and low speed hydraulic valves 40 and 42 to maintain the slide gate in position to hold the liquid metal in the mold at the desired level within acceptable limits. As shown in FIG. 2, two single-acting hydraulic cylinders 52, 54 are preferably employed to position the slide gate rather than the single double-acting cylinder 36 schematically shown in FIG. 1. The hydraulic control system includes the pump 38 which supplies pressure fluid through lines 56 and 58 to control valves 40 and 42, respectively. Lines 60 and 62, respectively, are connected to valves 40 and 42, respectively, to return fluid to the sump 64. A suitable pressure relief valve 66 may be provided for pump 38.

When the molten metal in the mold 24 is at the desired level, both valves 40 and 42 will be biased to their closed center position shown in FIG. 2. When sensor 30 detects a deviation from the desired level, the magnitude and direction of this deviation is signalled to the computer which calculates the change in nozzle open area needed to correct the mold level. Based upon the actual position of the slide gate as continuously sensed by transducer 44, the computer converts the needed open area change into a slide gate cylinder stroke required to produce the change, and transmits a signal to high speed control valve 40 to shift the valve in the direction to supply pressure fluid to cylinder 52 or 54 as required to move gate 18 in the appropriate direction. For example, if the liquid metal drops below the desired level, valve 40 will be shifted to supply pressure fluid to the piston end of cylinder 52 through line 60 and to connect the piston end of cylinder 54 to drain through lines 62, 68 and 70. To accomplish this, valve 40 would be shifted to the right as schematically illustrated in FIG. 2. The rod ends of cylinders 52 and 54 are vented to the atmosphere.

An adjustable throttling valve 72 is connected in line 68 to provide a controlled resistance to flow of hydraulic fluid from cylinder 54 back to the sump, and a bypass connected in the line around throttling valves 72 contains a one-way check valve 74 to permit the free flow of hydraulic fluid in the opposite direction around the throttling valve. A similar throttling valve 76 is connected in line 60 to resist flow from cylinder 52 back to drain, with a bypass containing check valve 78 providing free flow around the check valve to the cylinder 52.

As sliding gate 18 is moved, a signal corresponding to the actual gate position is continuously provided by transducer 44 to the computer 32 which compares the actual gate position with the desired position. When the gate position error becomes smaller than a predetermined value, the computer again shifts the high speed control valve to the closed center position. As the velocity of slide gate 18 approaches zero, low speed control valve 42 is shifted in a direction to supply pressure fluid at a low rate from line 58 through lines 80 and 60 to cylinder 52. At that time, the computer calculates a first cutoff velocity based upon the gate position error at the time of opening the low speed valve, this cutoff velocity being determined by the formula $V_{co}=E_2\times K_1$, wherein $E_2$ is the position error at the time of actuating the low speed valve and $K_1$ is a constant determined by the characteristics of the hydraulic actuating system.

When transducer 44 senses that the first cutoff velocity has been reached, the computer will shift the low speed valve to the closed center position and the actual gate position is again compared with the calculated gate position to determine a new gate position error. If this new gate position error is sufficiently small, both valves will remain closed until the sensor 30 senses that the liquid metal in mold 24 has again deviated from the desired level. If, however, the gate position error is not within acceptable limits as determined by the computer, a new cutoff velocity ($V_{co2}$) lower than the previously calculated cutoff velocity will be calculated and the low speed valve is again opened to continue movement of the gate until the new cutoff velocity is reached, at which time, the low speed valve is again shifted to the closed center position. This procedure is repeated automatically until the slide gate 18 is accurately located (within acceptable limits) in the position calculated by the computer to be required to bring the liquid metal to the desired level in the mold. This procedure allows for automatic compensation for any play or lost motion in the slide gate and actuating mechanism and compensates for any air or other gas which may have accumulated in the hydraulic lines. At the same time, it enables the use of rugged, off-the-shelf, inexpensive standard hydraulic components to achieve precise adjustment of the slide gate opening. For example, utilizing this system, it has been determined that the slide gate can be positioned within ±0.01 inches of the stroke calculated to be required to produce a desired valve opening area. In this regard, it is also noted that when the low speed valve 42 is open to supply pressure fluid to one of the gate actuating cylinders 52, 54, return through the valve to sump through line 82 is resisted by a third adjustable throttling valve 84 to provide a back pressure which minimizes lost motion in the system.

Referring now to FIGS. 3A, 3B, 3C and 3D, when the liquid metal in mold 24 deviates from the desired level, this condition is sensed by transducer 30 and a signal representing the magnitude and direction of the deviation is transmitted to the computer. The computer then determines the gate movement required to correct the metal level as described above, and this desired gate movement, or gate error, is represented at $E_1$ in FIG. 3A. The computer then actuates the solenoid of high speed valve 40 to shift the valve in the appropriate direction to open or close the slide gate and the gate is accelerated along the curve shown in FIG. 3B from zero to maximum velocity ($V_{max}$). The gate is moved at this maximum velocity until transducer 44 senses the gate position error has been reduced to a predetermined level, at which time the high speed control valve is closed (FIG. 3C) and the slide gate velocity drops rapidly as shown in FIG. 3B. As the slide gate velocity approaches zero, the gate position error $E_2$ is determined and since $E_2$ is greater than acceptable, low speed valve is opened and a first cutoff velocity $V_{co1}$ is calculated. When this first slide gate cutoff velocity is achieved, low speed valve 42 is closed (see FIG. 3D) and the gate position is again determined. Since gate position error has not been reduced to zero, low speed valve 42 is again opened and a second cutoff velocity $V_{co2}$ less than $V_{co1}$ is determined and valve 42 is again moved to a closed position by the computer when $V_{co2}$ is reached. This procedure is repeated until the gate position error approaches zero.

By providing a separate adjustable throttling valve in lines 60 and 68, more accurate control of the movement of gate 18 can be achieved during actuation of the high speed valve 40. However, since the gate 18 is moved at a substantially slower rate during actuation of low speed valve 42, it has been found that a single throttling valve on the return line 82 enables adequate control of the gate during low speed movement.

Utilizing the gate velocity feedback to the computer enables a much more reliable and accurate positioning of the gate valve over the prior systems and substantially reduces problems resulting from overadjusting or hunting of the system. Indeed, the variations in other factors such as liquid level in the tundish, or changes in the temperature of metal in the tundish with the resultant change in viscosity of the liquid metal can effect flow rates to an extent substantially greater than that produced by any error in adjustment of the slide gate achieved in accordance with the present invention.

While the invention has been described in relation to a continuous casting system of the type frequently employed in the casting of steel slabs, it is believed apparent that the invention may be employed with other casting arrangements. Thus, while the invention has been described with reference to a preferred embodiment, it should be understood that it is not so limited and it is intended to include all embodiments which would be apparent to one skilled in the art and which come within the spirit and scope of the invention.

What is claimed:

1. A method of controlling the pouring of molten metal into a mold of a continuous molten metal caster from a tundish having a variable outlet nozzle including a valve member movable to vary the area of the outlet nozzle opening, the method comprising the steps of monitoring the level of liquid metal in the mold and providing an electrical signal indicating both direction and magnitude of a detected deviation of said liquid metal level from a predetermined level, detecting the position of said valve member and providing an electrical signal representing said detected position, determining any necessary change in outlet opening area required to correct the detected deviation in liquid metal level, determining a valve position error representing the extent of movement of said valve member required to produce said necessary change in outlet opening area, applying a force to said valve member to initially move said valve member at a maximum velocity for a predetermined distance less than said valve position error and thereafter applying a force to further move said valve member in increments and determining the valve position error remaining after each incremental movement until the valve position error substantially equals zero, and monitoring the velocity of said valve member during each incremental movement and stopping the application of force to the valve member when the velocity of said valve member reaches a predetermined cutoff velocity less than said maximum velocity, the cutoff velocity after each successive incremental movement being less than the preceding cutoff velocity.

2. The method of claim 1 wherein said cutoff velocity for each incremental movement of said valve member is determined by said computer as a function of the valve member position error prior to each said incremental movement.

3. The method of claim 1 wherein said valve member comprises a sliding gate member supported for linear horizontal movement to vary the area of the outlet nozzle opening.

4. The method of claim 1 wherein hydraulic cylinder means is employed to move said valve member and wherein a first control valve controls the application of hydraulic fluid to said hydraulic cylinder means at a first rate during the initial movement of said valve member and a second control valve controls the application of hydraulic fluid to said hydraulic cylinder means at a second rate less than said first rate during each incremental movement of said valve member.

5. The method of claim 4 wherein said valve member comprises a sliding gate member supported for linear horizontal movement to vary the area of the outlet nozzle opening, and wherein the hydraulic cylinder means comprises a pair of hydraulic cylinders operatively connected to said sliding gate member, said hydraulic cylinders each being operable to move said gate member in one direction, the method further comprising the step of applying a resisting force to said gate member during any movement thereof to provide a more accurate positioning of said sliding gate member.

6. The method of claim 5 wherein said cutoff velocity for each incremental movement of said sliding gate member is determined by said computer as a function of the sliding gate member position error prior to each said incremental movement.

7. Apparatus for controlling the pouring of molten metal into a mold of a continuous molten metal caster from a tundish having a variable outlet nozzle including a valve member movable to vary the area of the outlet nozzle opening, comprising sensor means monitoring the level of liquid metal in the mold and providing an electrical signal indicating both direction and magnitude of any deviation of said liquid metal level from a predetermined level, means continuously detecting the position of said valve member and providing an electrical signal representing said detected position, computer means operable to determine a valve position error representing the extent of movement of said valve member required to produce a metal flow rate to correct a detected deviation in liquid metal level from said predetermined level, hydraulic actuator means operable to apply force to said valve member to initially move said valve member at a first velocity for a predetermined distance less than said valve position error and thereafter to apply force to further move said valve member at a velocity lower than said first velocity in increments, means determining the valve position error remaining after each incremental movement until the valve position error substantially equals zero, and means monitoring the velocity of said valve member during each incremental movement, said computer means being operable to control operation of said hydraulic actuator means to control application of force to said valve member and to stop the application of force to said valve member during each incremental movement when the velocity of said valve member reaches a predetermined cutoff velocity less than said first velocity, the cutoff velocity after each successive incremental movement being less than the preceding cutoff velocity.

8. The apparatus of claim 7 wherein said valve member comprises a sliding gate member supported for linear horizontal movement to vary the area of the outlet nozzle opening, and wherein said hydraulic actuator means includes cylinder means employed to move said sliding gate member, a first control valve controlling the application of hydraulic fluid to said hydraulic cylinder means at a first rate during the initial movement of said sliding gate member and a second control valve controls the application of hydraulic fluid to said hydraulic cylinder means at a second rate less than said first rate during each incremental movement of said sliding gate member.

9. The apparatus of claim 8 wherein the hydraulic cylinder means comprises a pair of hydraulic cylinders operatively connected to said sliding gate member, said hydraulic cylinders each being operable to move said gate member in one direction, said hydraulic actuator means further comprising throttle valve means applying a resisting force to oppose movement of said gate member to thereby provide a more accurate positioning of said sliding gate member.

* * * * *